United States Patent [19]

Andoniev et al.

[11] 4,061,317

[45] Dec. 6, 1977

[54] BLAST FURNACE BOTTOM COOLING ARRANGEMENT

[76] Inventors: Sergei Mikhailovich Andoniev, prospekt Pravdy, 5, kv. 60; Boris Ruvimovich Granovsky, prospekt Lenina, 88, kv. 70; Leonid Davydovich Golod, prospekt Pravdy, 7, kv. 192; Gennady Alexandrovich Kudinov, prospekt Gagarina, 32, kv. 203; Grigory Ivanovich Kasyanov, prospekt Lenina, 64b, kv. 63; Oleg Vladimirovich Filipiev, prospekt Pravdy, 5, kv. 41b; Jury Ivanovich Tseluiko, prospekt Lenina, 17, kv. 55; Evgeny Eliseevich Lysenko, Novgorodskaya ulitsa, 38/4, kv. 3, all of Kharkov, U.S.S.R.

[21] Appl. No.: 771,344

[22] Filed: Feb. 23, 1977

[51] Int. Cl.[2] ..... C21B 7/10

[52] U.S. Cl. ..... 266/193; 165/171

[58] Field of Search ..... 122/6 A, 7 R; 165/171; 266/190–194, 241

[56] References Cited

U.S. PATENT DOCUMENTS 3,704,747 12/1972 Andoniev et al. ..... 266/193

*Primary Examiner*—Gerald A. Dost

*Attorney, Agent, or Firm*—Lackenbach, Lilling & Siegel

[57] ABSTRACT

The arrangement for cooling the bottom of a blast furnace comprises cooling plates mounted between the furnace lining and shell and forming vertical and horizontal rows. Each cooling plate incorporates coil pipes situated in two planes parallel to the furnace shell, the coil pipes being connected to each other in vertical rows. There are at least two coil pipes in one of the vertical planes in each plate. Such coil pipes in the plates mounted in the uppermost horizontal row are connected to coil pipes mounted in the top portion of the furnace in two different vertical planes. At least one coil pipe is situated in the other vertical plane in each cooling plate. The coil pipes in the plates mounted in the lowermost horizontal row are controllably connected to cooling medium feed collectors of the furnace common cooling system and to a high-pressure cooling medium source. Same coil pipes incorporated in the plates mounted in the uppermost horizontal row are controllably connected to the cooling medium return collector of the furnace common cooling system and to a high-pressure cooling medium receiver.

7 Claims, 5 Drawing Figures

BLAST FURNACE BOTTOM COOLING ARRANGEMENT

The present invention relates to cooling arrangements employed in metallurgy applications, and more particularly to arrangements for cooling the bottom portion of a blast furnace.

The invention may find use in cooling the most heavily heat-loaded parts of metallurgical equipment and may be employed with particular advantage for cooling the well and hearth of a blast furnace.

Melted products (iron and slag) accumulated in great amounts at the bottom of a blast furnace have, by virtue of their high temperature and heavy pressure, a deteriorating effect on the refractory lining.

In modern blast furnaces the temperature in the well and hearth is as high as 1450°-1500° C and the liquid metal amounts to thousands of tons.

To protect the lining and to reduce the temperature of the lining and furnace shell, use is made of cooling elements, for example, cooling plates incorporating pipes or coils for conveyance of a cooling medium. Said plates are mounted between the furnace shell and lining around the perimeter in horizontal and vertical rows.

Provided that the lining of the well and hearth is undamaged, the thermal loads imposed on the plates are not high and the cooling systems known to be used currently operate normally under these conditions.

In the event of a damaged lining, liquid iron penetrates through it to the cooling plates, the thermal load increasing materially. Under these conditions there arises a possibility of a grave accident due to the cooling plates being destroyed and the liquid metal breaking out of the furnace.

The most critical zone of a furnace in this respect is its bottom part, viz. the well and hearth, where the temperature of accumulated melted materials is as high as or higher than 1450°-1500° C.

Reduction of furnace bottom temperature is effected by means of water circulation or evaporative cooling.

With the water circulation system, the cooling water is fed directly into the coil pipe in each cooling plate (or in two plates connected one after the other) from a feed collector and is returned directly into the cooling medium receivers. The circulating water flows in the coil pipes from the bottom upward and from the top downward.

With the evaporative cooling, system the coil pipes mounted in the cooling plates are connected to each other in vertical rows. The coil pipes in the cooling plates located in the lowermost horizontal row are connected to collectors feeding a cooling medium. The coil pipes in the cooling plates located in the uppermost horizontal row are connected to coil pipes which are mounted in the upper part of the furnace and are connected to return collectors. The feed and return collectors are connected to one cooling medium reservoir.

Thus, evaporative cooling is effected by a closed system wherein natural repeated circulation of the cooling medium occurs by virtue of a difference in the specific gravity of water and steam forming in the cooling elements (cooling plate coil pipes).

Known in the art is a blast furnace bottom cooling arrangement comprising cooling plates mounted between the furnace shell and lining in such a manner as to form vertical and horizontal rows. Each cooling plate incorporates pipes located in a vertical plane parallel to the furnace shell.

This arrangement works both for circulating water and for evaporative cooling. However, in emergency conditions, i.e. in the event of liquid metal reaching the cooling plates through a damaged lining, the arrangement under consideration does not provide sufficient heat transfer between the cooling plates and the furnace lining. As a result, the liquid metal may break out, thereby causing a grave accident.

Also known in the art is an arrangement designed for cooling the bottom of a blast furnace and comprising cooling plates mounted between the furnace shell and the lining in such a manner as to form vertical and horizontal rows. Each cooling plate incorporates coil pipes located in two vertical planes parallel to the furnace shell.

This arrangement works by feeding circulating water directly into the coil pipes in each cooling plate from a feed collector and returned it directly into cooling medium receivers. The cooling water circulates in the coil pipes in each plate from the bottom upward and from the top downward.

However, the use of circulating water results in the formation of scale and sludge on the interior surface of the coil pipes, whereby heat transfer between the cooling plate and the furnace lining is materially affected. No matter how pure the water and how small the usual thermal loads, scales inevitably form in the coil pipes with time.

Inasmuch as water circulates in the coil pipes from the bottom upward and from the top downward, steam locks form in the pipe coils, adversely affecting heat transfer between the cooling plates and the furnace lining.

Besides, the velocity of water flow in the coil pipes is 1-2.5 m/s, whereas, to maintain the cooling performance of the plates under heavy thermal loads, i.e. when liquid iron reaches the plates through a damaged lining, a water velocity of 8-10 m/s is necessary.

It is practically impossible to operate said arrangement at such a water velocity as it would be necessary to supply water to the furnace bottom alone at a rate of 3,000,000-4,000,000 t/h and a pressure of 10-15 kg/cm$^2$.

Moreover, at a high rate of water flow it is difficult to automatically detect emergency conditions by measuring heat loads or a water temperature drop.

Further, a scale deposit resulting from long service of the cooling plates materially reduces heat exchange between the cooling plates and the furnace lining even at a high water velocity.

It is also known in the prior art to use a furnace bottom cooling arrangement designed to work on the evaporative principle.

Said arrangement comprises cooling plates mounted between the furnace shell and lining so that they form vertical and horizontal rows. Each cooling plate incorporates coil pipes located in two planes parallel to the furnace shell, said coil pipes being connected to each other in vertical rows. The coil pipes in the cooling plates located in the lowermost horizontal row are connected to cooling medium feed collectors. The coil pipes in the cooling plates located in the uppermost horizontal row are connected to coil pipes mounted in the top portion of the furnace and are connected to cooling medium return collectors. The feed and return collectors are connected to one cooling medium reservoir.

Thus, evaporative cooling is effected by a closed system wherein natural repeated circulation of the cooling medium occurs by virtue of a difference in the specific gravity of water and steam forming in the cooling elements (cooling plate coil pipes).

It follows that the blast furnace bottom cooling arrangement working on the evaporative cooling principle has an advantage over comparable water circulating arrangements in providing better heat transfer between the cooling plates and the furnace lining.

However, in the event of damage to the furnace lining and much iron reaching the cooling plates the cooling provided by the arrangement concerned will not be sufficient.

It is the principle object of the present invention to provide a blast furnace bottom cooling arrangement which will prevent break-through of liquid metal.

It is a further object of the present invention to provide a blast furnace bottom cooling arrangement which will provide for intensification and regulation of heat exchange between the cooling plates and the furnace lining.

It is a still further object of the present invention to provide a blast furnace bottom cooling arrangement which will enable the cooling plates to be more durable and dependable than those known in the prior art.

These and other objects are achieved by a blast furnace bottom cooling arrangement comprising cooling plates mounted between the furnace lining and shell, the plates forming vertical and horizontal rows and incorporating coil pipes situated in two planes parallel to the furnace shell, the coil pipes being connected to each other in vertical rows, the coil pipes in the plates located in the uppermost horizontal row being connected to coil pipes provided in the top portion of the blast furnace, and the coil pipes in the plates located in the lowermost horizontal row being connected to a furnace common cooling system feed collector.

According to the invention, each cooling plate comprises at least two coil pipes situated in one vertical plane, the coil pipes in the plates located in the uppermost horizontal row being connected to coil pipes mounted in the top portion of the blast furnace in two different vertical planes, and each cooling plate also comprises at least one coil pipe situated in the other vertical plane, the coil pipes in the plates located in the lowermost horizontal row being controllably connected to furnace common cooling system feed collectors and to a collector provided in the source of a high-pressure cooling medium, the coil pipes situated in the other vertical plane in the plates located in the uppermost horizontal row are controllably connected to furnace common cooling system return collectors and to a receiver of the high-pressure cooling medium.

Inasmuch as at least two coil pipes are situated in one vertical plane and the coil pipes in the plates located in the uppermost horizontal row are connected to coil pipes mounted in the upper portion of the blast furnace in two different planes, the upper portion of the common cooling system and its connecting piping remain unchanged as compared with the cooling arrangements known in the prior art.

This provides for a constructional arrangement wherein each plate in the bottom portion of the plate comprises at least one coil pipe situated in the other vertical plane, all the coil pipes in the plates located in the lowermost horizontal row being controllably connected to a common cooling system feed collector and to a collector provided in the source of a high-pressure cooling medium, and the coil pipes in the plates located in the uppermost horizontal row are being controllably connected to furnace common cooling system return collectors and to a receiver of the high-pressure cooling medium.

With this construction, in the event of lining damage and penetration of liquid iron to the cooling plates heat exchange in the furnace well and hearth is considerably intensified by virtue of providing a high velocity of the cooling medium in the hazardous zone. Subsequently heat exchange can be regulated by feeding the cooling medium into the coil pipes from various sources.

The increase in the intensity of heat exchange is also conductive to reducing the temperature of the cooling medium in the plate coil pipes connected to the coil pipes in the plates mounted in the upper portion of the furnace.

This increases the water temperature margin below the boiling point and, accordingly, increases the value of the critical heat flow.

Thus, the functioning of the cooling plates in the bottom portion of the furnace is rendered more dependable in the event of damage to the furnace lining and a sharp increase in the thermal load. Further, the possibility of liquid metal breaking out to the furnace shell is eliminated.

It is desirable that at least one of the coil pipes situated in the other vertical plane in each of the adjacent plates in the uppermost horizontal row be connected to different return collectors of the furnace common cooling system. Such an arrangement will provide uniform supply of the cooling medium to all the coil pipes in the plates mounted in the furnace bottom portion, when evaporative cooling is employed.

It is further desirable that at least one of the coil pipes situated in the other vertical plane in each of the adjacent plates in the uppermost horizontal row be connected to the return collectors of the furnace common cooling system and to the high-pressure cooling system receiver via its own collector.

This construction will simplify the arrangement and operation of the cooling piping and the switchover of the furnace bottom cooling system to various sources of the cooling medium.

It is still further desirable that at least one of the coil pipes situated in the other vertical plane in each of the adjacent plates in the lowermost horizontal row be connected to different feed collectors of the furnace common cooling system. This will provide uniform supply of the cooling medium to all the coil pipes in the plates mounted in the furnace bottom portion, when evaporative cooling is employed.

It is still further desirable that said other vertical plane in which at least one coil pipe is situated in each cooling plate should be positioned nearer the furnace lining. This construction will simplify the monitoring of the cooling system working conditions and improve heat exchange between the cooling plate and the furnace lining.

It is still further desirable that said other vertical plane in which at least one coil pipe is situated in each cooling plate should be positioned nearer the furnace shell. This construction will provide for smooth regulation of heat exchange between the cooling plates and the furnace shell by switching over the supply of the cooling medium to the coil pipes located in the vertical plane nearer the furnace shell.

It is still further desirable that the coil pipes situated in said other plane in each cooling plate should run across the entire plate width. This construction will provide for uniform and sure cooling of all the plate areas and intensify heat exchange between the cooling plates and the furnace lining in the event of lining damage and liquid metal reaching the plates.

Thus, the present invention protects against breakthrough of liquid metal to the periphery of the furnace lining.

Further, the present invention provides for intensification and regulation of heat exchange between the cooling plates and the furnace lining.

Furthermore, the durability and dependability of the cooling plates are improved over those employed in furnace bottom cooling arrangements known in the prior art.

Now the invention will be described in detail with reference to the accompanying drawings in which.

Figure 3:
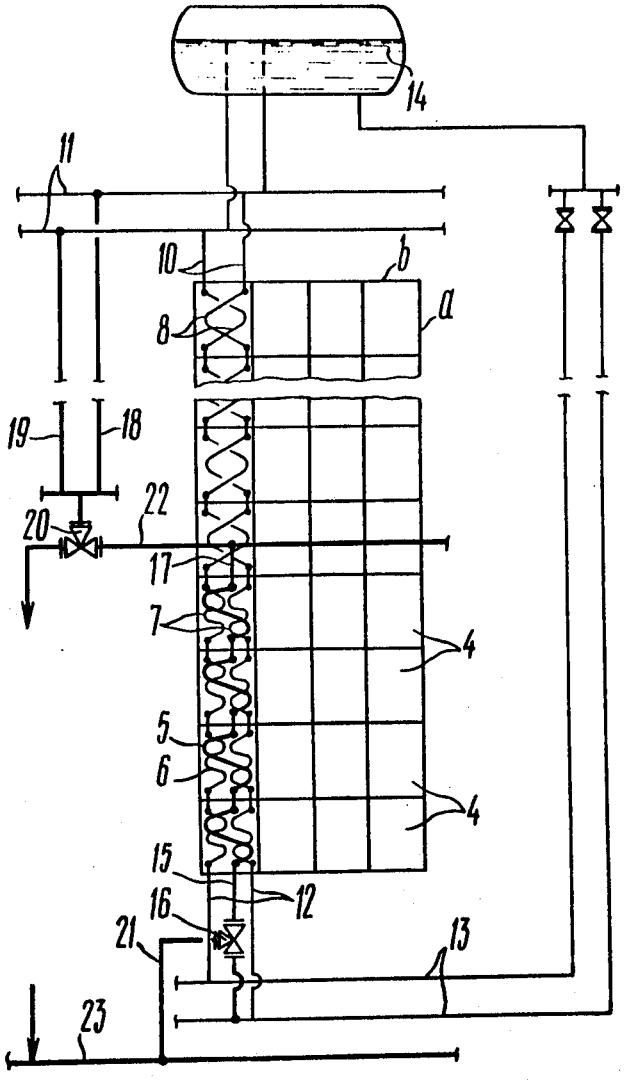
FIG. 3 is a cutaway side view showing the location of cooling plates with coil pipes.

The arrangement designed for cooling a blast furnace bottom 1 (FIG. 1) comprises cooling plates 4 mounted between a furnace lining 2 and a furnace shell 3. Said plates 4 from vertical rows designated by the letter "*a*" (FIG. 3) and horizontal rows designated by the letter "*b*".

Figure 1:
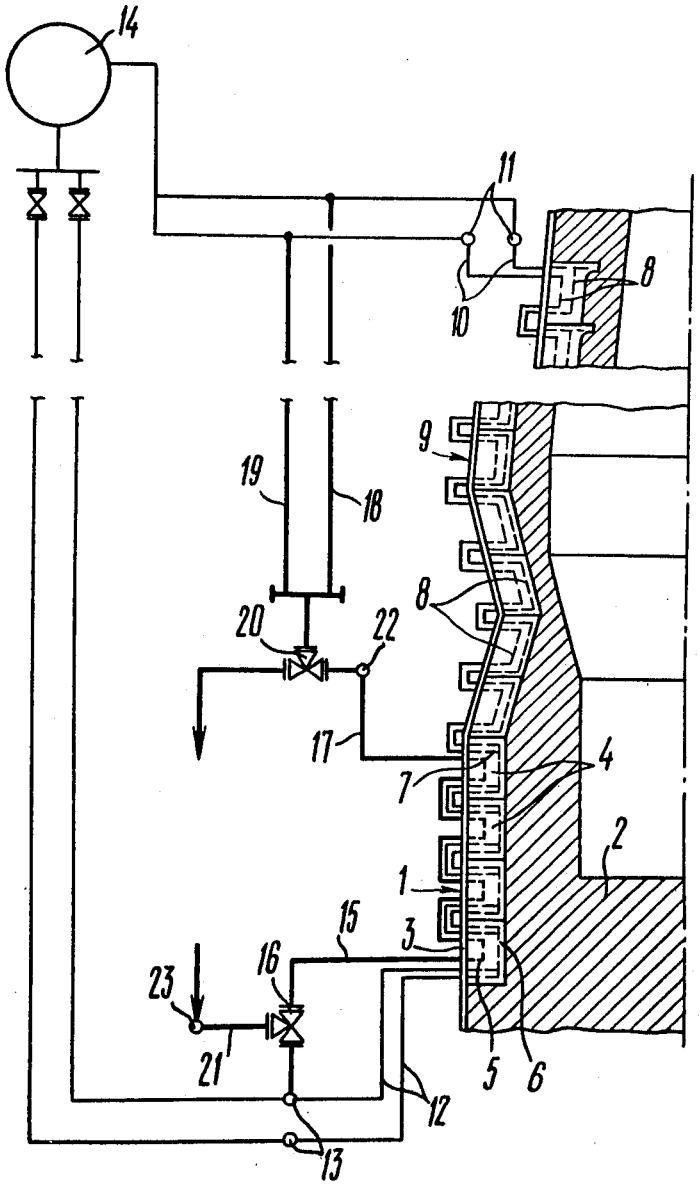
FIG. 1 is a cutaway vertical front view, partially in section, showing one half of a blast furnace with a bottom cooling arrangement constructed in accordance with the present invention.
Figure 2:
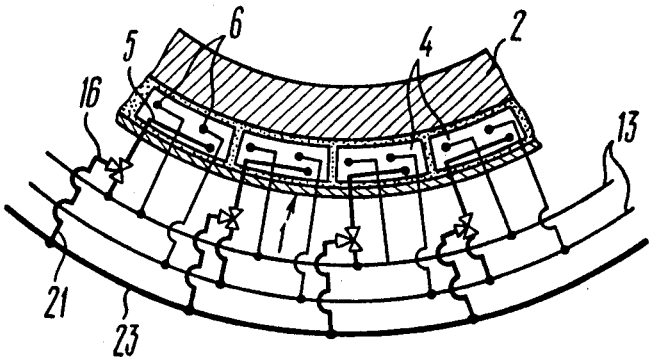
FIG. 2 is a fragmentary top cross sectional view of a horizontal plane showing a furnace bottom portion constructed in accordance with the invention.
Figure 4:
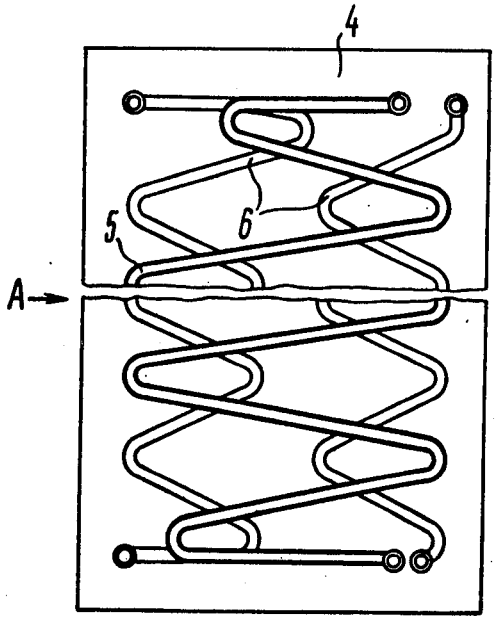
FIG. 4 is a cutaway view showing the location of coil pipes in each cooling plate.

Coil pipes 5 and 6 (FIGS. 2 and 4) are situated in each plate 4 in two vertical planes "*c*" and "*d*" (FIG. 5) parallel to the furnace shell 3 (FIG. 1).

There are two coil pipes 6 (FIGS. 2 and 4) situated in the vertical plane "*c*" in each plate 4. Coil pipes 7 (FIG. 3) in each plate mounted in the uppermost horizontal row "*b*" are connected to coil pipes 8 (FIG. 1) situated in the furnace upper portion 9 in two different vertical planes.

Said coil pipes 8 situated in plates mounted in the upper portion of the furnace are connected by pipelines 10 to cooling medium return collectors 11.

The coil pipes 6 situated in the plates mounted in the lowermost horizontal row in the furnace bottom are connected by pipelines 12 to cooling medium feed collectors 13.

Said collectors 11 and 13 are connected to a cooling medium reservoir 14.

Figure 5:
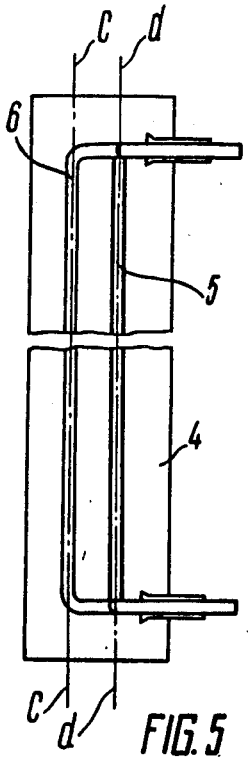
FIG. 5 is an enlarged detail view in the direction of the arrow A in FIG. 4.

One coil pipe 5 (FIG. 4) is situated in each plate 4 in the vertical plane "*d*" (FIG. 5). Said coil pipe runs across the entire width of the plate to provide for uniform and sure cooling of all the plate areas and to intensify heat exchange between the cooling plates and the furnace lining in the event of lining damage and liquid metal reaching the cooling plates.

In the embodiment under consideration one coil pipe 5 is situated in the vertical plane "*d*" nearer the furnace lining, which provides for simplifying the monitoring of the cooling system operating conditions and for improving heat transfer between the cooling plates and the furnace lining.

However, said coil pipe 5 may be situated in the vertical plane "*c*" (FIG. 5) nearer the furnace shell, which will provide smooth regulation of heat exchange between the cooling plates and the furnace lining.

The coil pipes 5 (FIG. 1) situated in the plates 4 mounted in the lowermost horizontal row are connected to the feed collectors 13 via pipelines 15 fitted with a valve 16.

The coil pipes 5 situated in the plate mounted in the uppermost horizontal row in the furnace bottom are connected to the return collectors 11 via pipelines 17, 18, and 19 fitted with valves 20.

This arrangement enables all the coil pipes situated in the plane "*d*" (FIG. 5) to operate on the principle of evaporative cooling.

The coil pipes 5 (FIG. 1) in the adjacent plates mounted in the lowermost horizontal row are connected to different feed collectors 13 of the common cooling system. The coil pipes 5 in the adjacent plates mounted in the uppermost horizontal row in the furnace bottom are connected to different return collectors 11 via the pipelines 18 and 19. This construction provides a uniform cooling medium supply to all the coil pipes in the plates when the arrangement works fully on evaporative cooling.

The coil pipes 5 in the plates mounted in the lowermost horizontal row are connected to a high-pressure cooling medium feed collector 23 via pipelines 15 and 21 fitted with a valve 16. The coil pipes 5 situated in the plates 4 mounted in the uppermost horizontal row are connected to a high-pressure cooling medium receiver (not shown) via a pipeline 17 and a collector 22 with a valve 20. The provision for feeding the coil pipes 5 in the plates 4 mounted in the furnace bottom from a separate high-pressure cooling medium source (collector 23) makes it possible to considerably intensify heat transfer in the event of a damaged lining and liquid iron reaching the plates, the intensification of the heat transfer being achieved by virtue of producing a high-velocity cooling medium flow in the coil pipes 5 located in the hazardous zone. This also reduces the temperature of the cooling medium in the coil pipes 6 situated in the plates 4 mounted in the furnace bottom, thereby increasing the water temperature margin below the boiling point and, accordingly, increasing the value of the critical heat flow in said coil pipes 6 operating on the evaporative cooling principle.

Thus, heat exchange between the cooling plates and the furnace lining is intensified appreciably, the dependability of the cooling plate operation in the hazardous zone is improved, and provision is made for preventing the possibility of liquid metal breaking out through the furnace shell.

The coil pipes 5 situated in the plates 4 mounted in the uppermost horizontal row in the furnace bottom are connected to their own collector 22 via the pipeline 17, whereby the layout and handling of the cooling system are simplified and the switchover of the furnace bottom cooling system is made easier.

The blast furnace bottom cooling arrangement which constitutes the present invention operates as follows:

From the reservoir 14 the cooling medium is supplied via the feed collectors 13, the pipelines 12 and the pipeline 15 with the valve 16 to the coil pipes 5 and 6 situated in different vertical planes in the plates 4 mounted in the furnace bottom 1.

From the coil pipes 6 situated in the plane "c" the cooling medium passes into the coil pipes 8 in the plates mounted in the upper portion of the furnace. In the coil pipes 6 and 8 throughout the furnace the temperature of the cooling medium is brought to the boiling point and the difference in the specific weight between the water and the steam causes natural repeated circulation. From the coil pipes 8 situated in the plates mounted in the upper portion of the furnace the cooling medium passes through the pipelines 10 into the return collectors 11 and therefrom into the reservoir 14.

The cooling medium in the coil pipes 5 situated in the plates 4 mounted in the furnace bottom is also heated to the boiling point and the difference in the specific gravity between the water and the steam causes circulation in said coil pipes.

From the uppermost coil pipes 5 in the cooling plates 4 mounted in the uppermost horizontal row in the furnace bottom the cooling medium passes via the pipelines 17, the coil pipe collector 22, the valve 20, and the pipelines 18 and 19 into the return collectors 11, wherefrom the cooling medium also passes into the reservoir 14.

The coil pipes 5 and 6 in the plates 4 mounted in the furnace bottom operate in this mode under normal conditions, when the furnace lining is undamaged.

In the event of damage to the furnace lining and penetration of liquid iron to the cooling plates (which may be indicated by an increase in the cooling medium temperature differential, a rise of the furnace shell temperature and other signs), the coil pipes 5 in the plates 4 mounted in the furnace bottom can be switched over to a high-pressure cooling medium source.

In this case the high-pressure cooling medium is supplied from the feed collector 23 to the lowermost coil pipes 5 via the pipelines 15 and 21 and the valve 16.

On the flowing through all the coil pipes 5 in the plates 4 mounted in the furnace bottom, the cooling medium passes through the coil pipes 5 in the plates 4 mounted in the uppermost horizontal row in the furnace bottom and thence, via the pipelines 17, the coil pipe collector 22, and the valve 20, into the high-pressure cooling medium receiver.

In the event of lining damage this mode of cooling makes it possible to considerably intensify the heat exchange in the dangerous zone by virtue of producing a high-velocity cooling medium flow in the coil pipes 5 and thereby to keep the temperature of the cooling plates concerned within the permissible limits.

Furthermore, reduction of the temperature of the cooling medium in the coil pipes 6 situated in the plates 4 mounted in the furnace bottom increases the cooling medium temperature margin below the boiling point and, accordingly, increases the value of the critical heat flow when said coil pipes work in an evaporative cooling mode.

Thus, heat transfer between the cooling plates and the furnace lining is intensified materially, the dependability of the cooling plate operation in the hazardous zone is enhanced, and provision is made against the possibility of liquid metal breaking out through the furnace shell.

Research has shown that the blast furnace bottom cooling arrangement constituting the present invention makes it possible to materially intensify heat exchange between the cooling plates and the furnace lining in the event of lining damage and penetration of liquid iron to the lining periphery, and also to enhance the dependability of the operation of the cooling plates in hazardous conditions.

All these advantages lengthen the life of the blast furnace involved, promoting an increase in iron output.

The cooling arrangement constituting the present invention is more economical than circulating water cooling arrangements known in the prior art.

What is claimed is:

1. An arrangement for cooling the bottom portion of a blast furnace having a shell, which is lined with a refractory material and is divided into an upper and a bottom portion, plates, which are mounted in the furnace upper portion between the shell and the lining, and coil pipes incorporated in said plates and being situated in two vertical planes parallel to the furnace shell, comprising: plates mounted in said bottom portion of the furnace between the shell and lining thereof, said plates forming vertical and horizontal rows; coil plates situated in each of said plates in two vertical planes parallel to the furnace shell, there being at least two coil pipes in a first of said vertical planes and at least one coil pipe in a second of said vertical planes; said coil pipes in said first vertical plane of said plates mounted in the uppermost horizontal row being connected to said coil pipes of said plates situated in the upper portion of the furnace; cooling medium feed collectors of the furnace common cooling system controllably connected to said coil pipes provided in said plates mounted in the lowermost horizontal row; a high-pressure cooling medium collector controllably connected to said coil pipes in said second vertical plane of said plates mounted in the lowermost horizontal row; cooling medium return collectors of the furnace common cooling system controllably connected to said coil pipes in said first vertical plane of said plates mounted in the uppermost horizontal row and to said coil pipes provided in said plates in said furnace upper portion; and a high-pressure cooling medium receiver controllably connected to said coil pipes in said second vertical plane of said plates mounted in the uppermost horizontal row.

2. An arrangement as claimed in claim 1, in which the coil pipes in said second vertical plane of the adjacent plates mounted in the uppermost horizontal row are connected to different cooling medium return collectors of the furnace common cooling system.

3. An arrangement as claimed in claim 1, in which the coil pipes in said second vertical plane of the adjacent plates of the uppermost horizontal row are connected via their own collector to the cooling medium return collectors of the furnace common cooling system and to the high-pressure cooling medium receiver.

4. An arrangement as claimed in claim 1, in which the coil pipes in said second vertical plane of the adjacent plates mounted in the lowermost horizontal row are connected to different cooling medium feed collectors of the furnace common cooling system.

5. An arrangement as claimed in claim 1, in which the second vertical plane wherein at least one coil pipe is situated in each plate is positioned nearer the furnace lining.

6. An arrangement as claimed in claim 1, in which the second vertical plane wherein at least one coil pipe is situated in each plate is positioned nearer the furnace shell.

7. An arrangement as claimed in claim 1, in which the coil pipes in said second vertical plane in each plate run across the entire width of the plate.

* * * * *